US006572408B2

(12) United States Patent
Yamanashi et al.

(10) Patent No.: US 6,572,408 B2
(45) Date of Patent: Jun. 3, 2003

(54) CONNECTOR HOUSING HAVING THIN-WALLED PORTION TO FACILITATE INSPECTION AND METHOD OF MANUFACTURING THE SAME

(75) Inventors: Makoto Yamanashi, Shizuoka (JP); Eiji Fukuda, Shizuoka (JP); Shigeru Tanaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/981,260

(22) Filed: Oct. 18, 2001

(65) Prior Publication Data

US 2002/0045384 A1 Apr. 18, 2002

(30) Foreign Application Priority Data

Oct. 18, 2000 (JP) ..... 2000-318000

(51) Int. Cl.[7] ..... H01R 13/40; H01R 13/514; H01R 13/428

(52) U.S. Cl. ..... 439/595; 439/752; 439/744

(58) Field of Search ..... 439/595, 752, 439/600, 594, 352, 736, 744; 264/513, 167

(56) References Cited

U.S. PATENT DOCUMENTS

| | | | | | |
|---|---|---|---|---|---|
| 4,159,300 | A | * | 6/1979 | Wise | 264/278 |
| 5,601,454 | A | | 2/1997 | Suzuki et al. | |
| 5,989,066 | A | * | 11/1999 | Cox | 439/595 |
| 6,435,920 | B2 | * | 8/2002 | Kashiyama | 439/752 |

FOREIGN PATENT DOCUMENTS

| | | |
|---|---|---|
| EP | 0902504 A2 | 3/1999 |

* cited by examiner

*Primary Examiner*—Chandrika Prasad
(74) *Attorney, Agent, or Firm*—Sughrue Mion, PLLC

(57) ABSTRACT

A connector housing is formed with a chamber into which a terminal is inserted. A retention member is formed in the chamber so as to retain the inserted terminal therein. The retention member is formed by a first portion of a mold which molds the housing. An inspection member is formed on an outer face of the housing for inspecting molding defect of the retention member. The inspection member is formed by a second portion of the mold having a higher flow resistance than the first portion of the mold.

19 Claims, 5 Drawing Sheets

CONNECTOR HOUSING HAVING THIN-WALLED PORTION TO FACILITATE INSPECTION AND METHOD OF MANUFACTURING THE SAME

BACKGROUND OF THE INVENTION

The present invention relates to a connector housing having thin-walled portions formed for inspecting short-shots in terminal retaining lances of the connector housing, and a method of manufacturing the same.

FIG. 9 shows an example of a related spacerless connector. A connector housing 40 of this type is formed of a synthetic resin and has therein a plurality of terminal chambers 41 which are juxtaposed horizontally in two upper and lower stages. Insertion ports 42 for inserting terminals 60 are provided in its rear side, while insertion ports 43 into which tab-like electrical contact portions (not shown) of male-type terminals which are mating terminals are inserted are formed in its front side. The terminal chambers 41 are defined by vertical partition walls 44, horizontal partition walls 45, upper and lower wall portions 46 and 47, and left and right wall portions 48 and 49. To be accurate, the terminal chambers 41 on both sides include the left and right wall portions 48 and 49 as constituent elements.

As each terminal 60 is inserted in the respective terminal chamber 41, the terminal 60 upwardly deflects a flexible terminal retaining lance 50 inside the terminal chamber 41. As the terminal 60 is further inserted, the terminal 60 is retained by the terminal retaining lance 50 which has returned resiliently. The terminal 60 is fabricated by bending a thin metal sheet stamped out by press working. A box-shaped electrical contact portion 61 having a spring piece for contact provided therein is formed in a front half of the terminal 60, while a first clamping portion 62*a* for clamping an insulating coating of an electric wire 65 and a second clamping portion 62*b* for clamping a core wire are respectively formed with U-shaped cross sections in a rear half of the terminal 60. The terminal in this example is of the so-called female type.

The electrical contact portion 61 formed in a box shape by uprighting side plates 63 from both sides of a bottom plate and by orthogonally bending an extended portion of one side plate 63 toward the other side plate 63 side. Further, a downwardly inclined face 64 is formed on the rear side of the electrical contact portion 61 via a stepped portion. A vertical end face of the stepped portion serves as a portion to be retained corresponding to the terminal retaining lance 50.

The connector housing in this example is not provided with spacers for secondarily retaining the terminals 60. Accordingly, the terminals 60 are not doubly retained, and are retained by the terminal retaining lances 50 alone, so that the connector housing 40 has simple construction.

The connector housing 40 is formed by injecting a molten resin into an unillustrated cavity and allowing the resin to cool and solidify. At this time, the terminal retaining lances 50 of the connector housing 40 are also formed integrally. The connector housing 40 in this example if of the so-called male type.

However, with the above-described connector housing and a method of manufacturing the same, particularly in the case of the connector housings for which there is a demand for downsizing, the vertical partition walls and horizontal partition walls must be set to be thin, and concern has been felt that these partition walls may result in molding defect which is so-called short-shots during injection molding. Particularly in the case of the terminal retaining lances which are projectingly provided in a cantilevered manner from the inner walls, there has been greater concern for the short-shots.

In the case where there has been a short-shot in the terminal retaining lance of the spacerless connector, the terminal can come off, or faulty connection can result, so that the short-shot has been a serious problem. Accordingly, short-shots in the terminal retaining lances are checked by visual inspection or by an image processor.

SUMMARY OF THE INVENTION

In view of the above-described aspects, it is an object of the invention to provide a connector housing and a method of manufacturing the same which make it possible to easily and accurately inspect short-shots in the terminal retaining lances at the time of injection molding.

In order to achieve the above object, according to the present invention, there is provided a connector housing, formed with a chamber into which a terminal is inserted, comprising:

a retention member, formed in the chamber so as to retain the inserted terminal therein, the retention member formed by a first portion of a mold which molds the housing; and an inspection member, formed on an outer face of the housing for inspecting molding defect of the retention member, the inspection member formed by a second portion of the mold having a higher flow resistance than the first portion of the mold.

According to the present invention, there is also provided a connector housing, formed with a chamber into which a terminal is inserted, comprising:

a retention member, formed in the chamber so as to retain the inserted terminal therein; and an inspection member, formed on an outer face of the housing for inspecting molding defect of the retention member, the inspection member having a thickness dimension thinner than the retention member.

According to the present invention, there is also provided a mold, for molding a connector housing which is formed with a chamber into which a terminal is inserted, a retention member formed in the chamber so as to retain the inserted terminal therein, and an inspection member for inspecting molding defect of the retention member, comprising:

a first portion, having a first flow resistance, for forming the retention member; and a second portion, having a second low resistance higher than the first flow resistance, for forming the inspection member on an outer face of the housing.

Preferably, the mold further comprises a third portion, from which molten resin for forming the housing is injected. Here, the second portion is furthest from the third portion such that the molten resin is lastly fills the second portion.

According to the present invention, there is also provided a method of manufacturing a connector housing which is formed with a chamber into which a terminal is inserted, a retention member formed in the chamber so as to retain the inserted terminal therein, and an inspection member for inspecting molding defect of the retention member, comprising the steps of:

providing a mold for molding the connector housing;

providing a first portion for forming the retention member in the mold so as to have a first flow resistance member:

providing a second portion for forming the inspection member in the mold at a position where is to be an outer face of the housing, so as to have a second flow resistance higher than the first flow resistance;

injecting molten resin into the mold; and inspecting an external appearance of the molded inspection member to determine whether molding defect is present on the molded retention member.

Preferably, the second portion providing step includes the steps of, determining a third portion in the mold, from which the molten resin is injected; and determining the second portion as a portion where the molten resin lastly fills.

Here, it is preferable that the second portion is determined by performing a flow analysis of the molten resin within the mold.

In the above configurations, the inspection member is formed in a portion where the molding defect (short-shot) is most likely to occur. Namely, if the external appearance of the inspection member is checked, and a short-shot cannot be detected, it can be estimated that there are no short-shots in the retention member, and that the product can be evaluated as being nondefective. To the contrary, if there is a defect in the external appearance of the inspection member, it can be estimated that there is a defect in the retention member.

The third portion (injection gate) may be plurally provided. In this configuration, the flow of the molten resin is improved.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views; and wherein:

FIG. 8 is a diagram in which FIG. 7 is viewed from diagonally behind to show a spool, a runner, and gates;

DETAILED DESCRIPTION OF THE PREFERRED EMBODIMENTS

Referring now to the accompanying drawings, a detailed description will be given of one specific embodiment of the invention.

Figure 1:
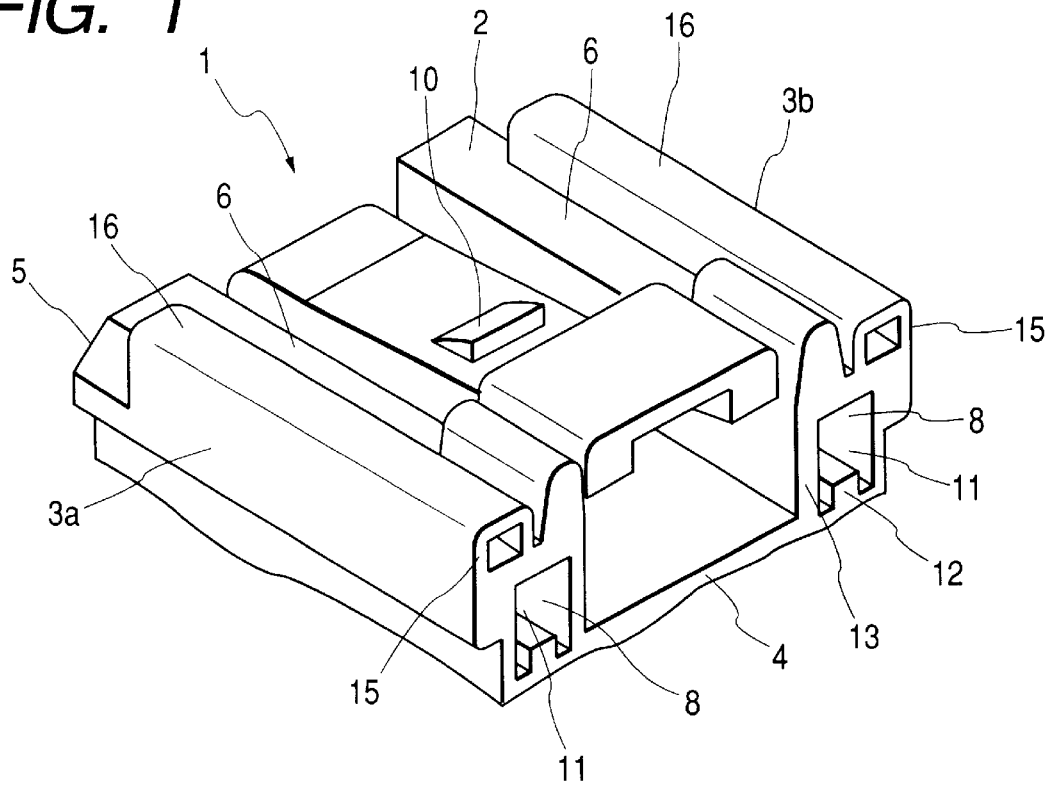
FIG. 1 is a partially enlarged perspective view illustrating one embodiment of a connector housing in accordance with the invention.

As shown in FIG. 1, thin-walled portions 15 for short-shot inspection of terminal retaining lances 20 (see FIGS. 5 and 6) are integrally formed on an outer wall upper portion 6 of a connector housing 1. The thin-walled portions 15 are formed at final filling positions which are most distant from gates 32 (see FIG. 8) of a runner 31 for injecting a molten resin into a cavity (mold), and are formed to be thinner than the terminal retaining lances 20. More specifically, the thin-walled portions 15 are respectively formed on both sides of the outer wall portion 6 of the connector housing 1 into open-ended elongated box shapes by extending shoulder portions 16.

Figure 2:
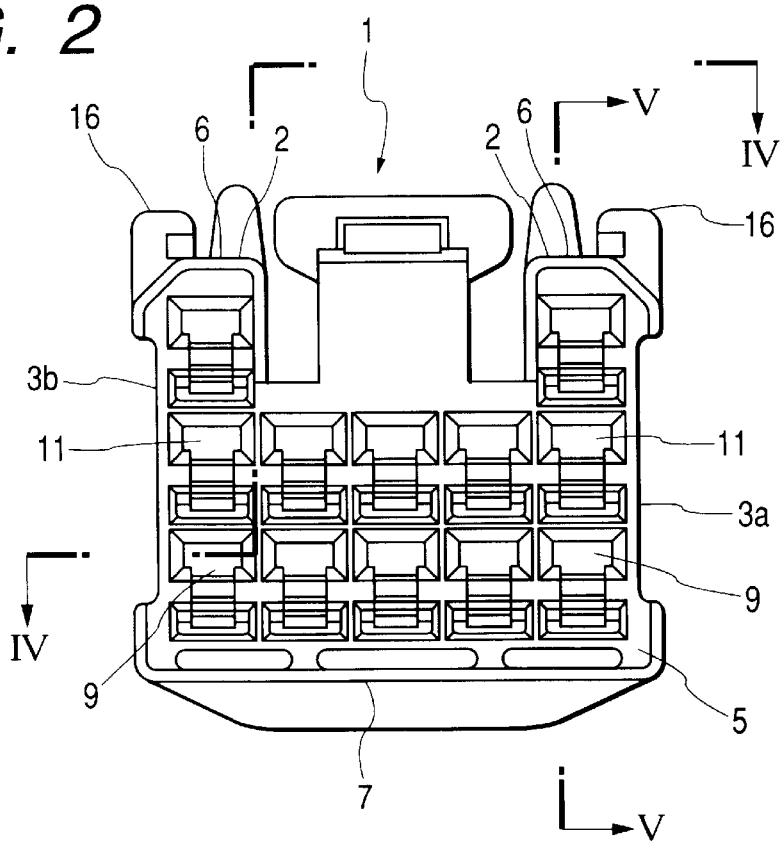
FIG. 2 is a front elevational view illustrating the connector housing.
Figure 3:
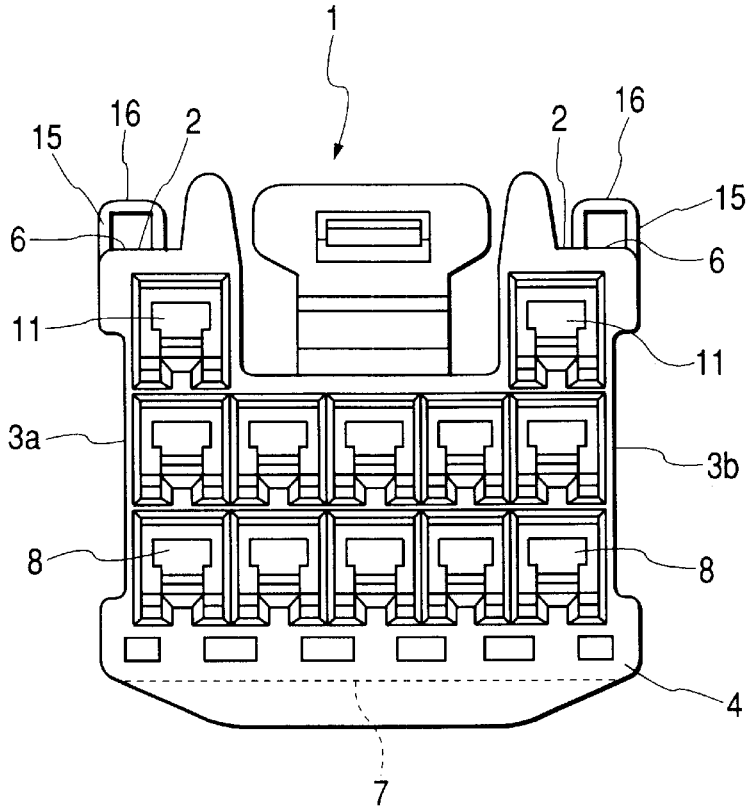
FIG. 3 is a rear view illustrating the connector housing.

As shown in FIGS. 2 and 3, the connector housing 1 in this embodiment is the connector housing 1 of the so-called male-type, and is molded by a synthetic resin. The connector housing 1 has a substantially flat square shape in terms of its external appearance, and is integrally formed by the following: a pair of outer wall side portions 3*a* and 3*b*; an outer wall rear portion 4 in which insertion ports 8 for inserting the terminals (not shown) is formed; an outer wall front portion 5 in which insertion ports 9 for inserting tab-like portions of male-type terminals serving as mating terminals are formed; the outer wall upper portion 6 on which a locking hook 10 for engaging with a locking recess of a female-type connector is formed; and an outer wall lower portion 7 where the gates 32 of the runner 31 are disposed.

To give a more detailed description, the insertion ports 8 of a plurality of terminal chambers 11 arranged in matrix form are open in the outer wall rear portion 4 of the connector housing 1. The insertion ports 9, which are open ends on one side of the terminal chambers 11, are open in the outer wall front portion 5 of the connector housing 1. Accordingly, the respective terminal chambers 11 are formed penetratingly from the outer wall front portion 5 to the outer wall rear portion 4 of the connector housing 1. The terminal chambers 11 are defined by horizontal partition walls 12 and vertical partition walls 13.

The terminal retaining lance 20 for retaining a portion to be retained which is provided in an intermediate portion of the rod-like terminal is projectingly provided on the bottom face of each terminal chamber 11. The terminal retaining lance 20 is formed in such a manner as to extend toward a front half engaging portion of the connector housing 1 in a cantilevered manner. A deflection space 25 for allowing the terminal retaining lance 20 to deflect downward is provided between the terminal retaining lance 20 and the bottom face of each terminal chamber 11. This deflection space 25 extends in the rear half portion of the connector housing 1. A withdrawing jig for canceling the retention of the terminal retaining lance 20 and pulling out the terminal is adapted to be inserted into the opening of this deflection space 25.

Figure 4:
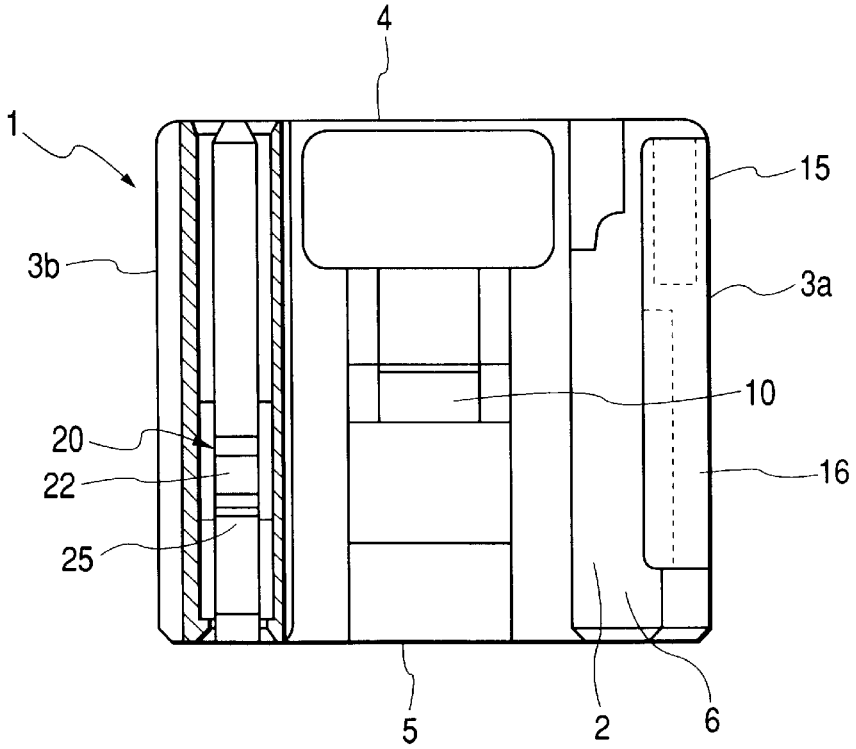
FIG. 4 is a partially cross-sectional view taken along line IV—IV of FIG. 2.
Figure 5:
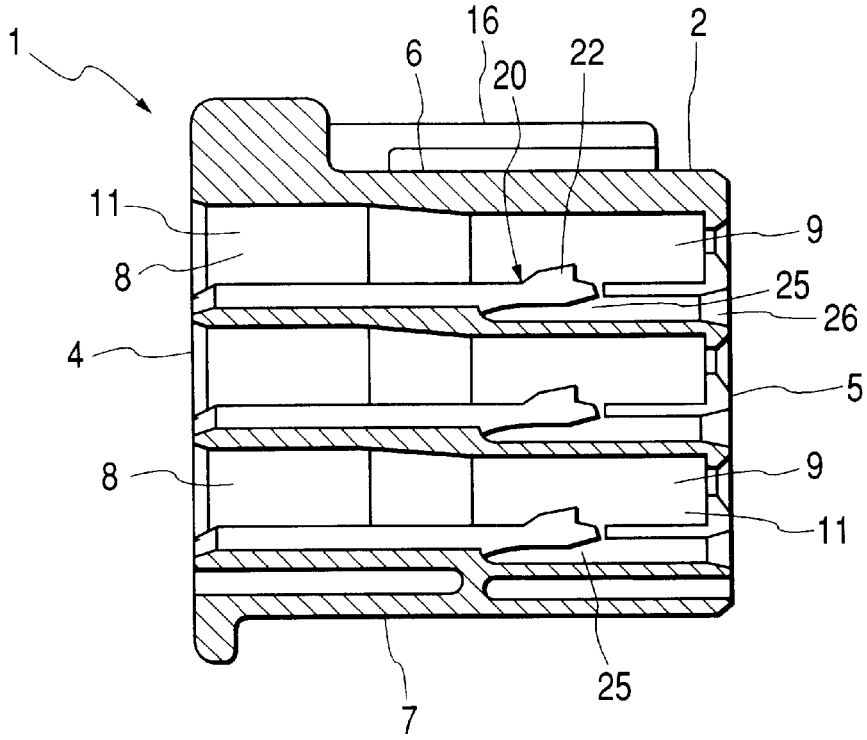
FIG. 5 is a cross-sectional view taken along line V—V of FIG. 2.
Figure 6A:
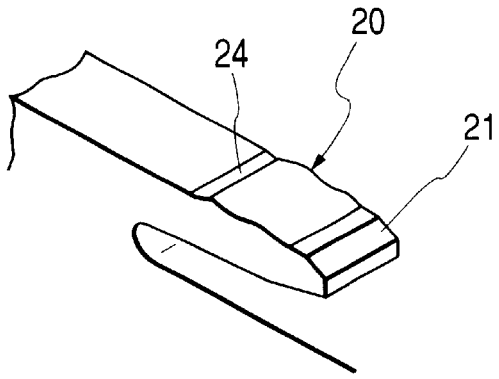
FIG. 6A shows a perspective view of a terminal retaining lance of a defective molded product.
Figure 6B:
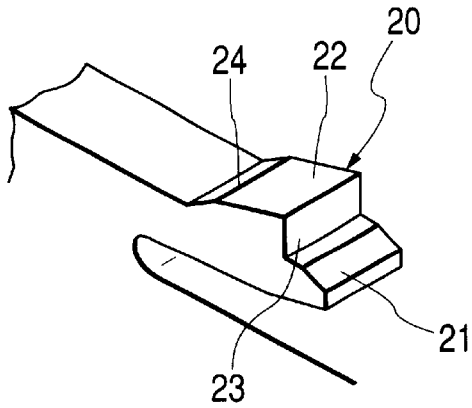
FIG. 6B shows a perspective view of a terminal retaining lance of a nondefective molded product.

As shown in FIGS. 4 to 6, a retaining projection 22 which projects toward the terminal side is formed at a narrowed distal end portion 21 of the terminal retaining lance 20. A retaining face 23 which is orthogonal to the inserting direction of the terminal is formed on the distal end side of the retaining projection 22. Further, an inclined face 24 which rises toward the insertion port 9 side is formed on the proximal end side of the retaining projection 22.

Next, a description will be given of the operation of the above-described terminal retaining lance 20. When the terminal is inserted through the insertion port 8, the distal end of the terminal abuts against the inclined face 24 of the terminal retaining lance 20 midway in the terminal chamber 11. When the terminal is further inserted, the inclined face 24 and the terminal undergo sliding contact with each other, and the terminal retaining lance 20 is deflected downward and moves to the deflection space 25. Then, when the terminal advances further forward, the retaining projection 22 enters the stepped portion formed in the box-shaped portion of the terminal, and the terminal retaining lance 20 returns resiliently. Consequently, the retaining face 23 of the retaining projection 22 and the stepped portion of the terminal abut against each other, thereby retaining the terminal.

Since such a terminal retaining lance 20 is formed to be thinner than the main body portion of the connector housing 1, as shown in FIG. 6, there are cases where a molding defect occurs (FIG. 6A). Such a defect is referred to as the short-shot. This is attributable to the characteristic of the resin flow. Namely, since the molten resin preferentially flows through a thick-walled portion where the flow resistance is low, the flowing into thin-walled portions such as the terminal retaining lances 20 and the like where the flow resistance is high takes place only at a final stage.

Accordingly, to prevent such short-shots in the terminal retaining lances 20, corrections are provided, as required, by such as changing the resin material to a material having excellent fluidity, increasing the injection pressure, and changing the positions of the gates. However, the molding conditions are not always constant, and it is difficult to maintain, for example, the temperature and the pressure at fixed levels, and there are cases where defective products are molded. In such a case, as described before, inspection has been performed by a time-consuming method. Accordingly, in the invention, the presence or absence of short-shots in the terminal retaining lances 20 is detected not by directly inspecting the terminal retaining lances 20 but by forming the thin-walled portions 15 on the connector housing 1 and inspecting these thin-walled portions 15 instead of the inspection of the terminal retaining lances 2.

As shown in FIGS. 1, 3, and 4, these thin-walled portions 15 are integrally formed on both sides of the outer wall portion 6 of the connector housing 1, and have open-ended elongated box shapes. The reason for the adoption of the open-ended elongated box shape is mainly based on the consideration of the molding characteristics. Although the thin-walled portion 15 may have such as rib shapes, for example, the open-ended elongated box shape is adopted to further increase the flow resistance of the molten resin. The thin-walled portions 15 having the open-ended elongated box shapes are disposed at the final filling positions of the molten resin on the basis of the result of flow analysis conducted, as will be described later.

Next, a description will be given of the method of manufacturing the connector housing 1. The thin-walled portions 15 for preventing short-shots in the terminal retaining lances 20 are formed so as to assume final filling positions which are farthest from the gates 32 disposed on both sides of the outer wall lower portion 7 of the connector housing 1. Namely, the gates of the runner 31 are disposed on both sides of the outer wall lower portion, and the thin-walled portions 15 are disposed on both sides of the outer wall upper portion 6.

The injection molding of the connector housing 1 is effected through an ordinary molding process which will be described below. The molding process is composed of five steps including a plasticization step, an injection step, a compression step, a dwelling step, and a cooling step.

First, the plasticization step is a step for melting a resin by the screw method or the like. By reducing variations of the viscosity of the molten resin, it is possible to prevent the occurrence of burrs and variations of the dimensional accuracy.

The injection step is a step for injecting the molten resin into the cavity through the spool 30, the runner 31, and the gates 32 in the mold. This step is one which exerts a strong influence on the quality of the molded products since it determines the molecular orientation of the resin. Through this step, the molten resin injected from the gates 32 first flows through thick-walled portions where the flow resistance is low.

The compression step is a step in which the flow pressure is high immediately before the resin is filled in the cavity. By means of this step, the molten resin flows to the terminal retaining lances 20, and finally flows to the thin-walled portions having the open-ended elongated box shapes, completing the filling.

The dwelling step is a step until the gates 32 are sealed (solidified), and compensates for the portion of volume shrinkage at the time when the resin filled through the injection to compression steps is cooled. The cooling step is one until the molded product cools and solidifies.

Figure 7:
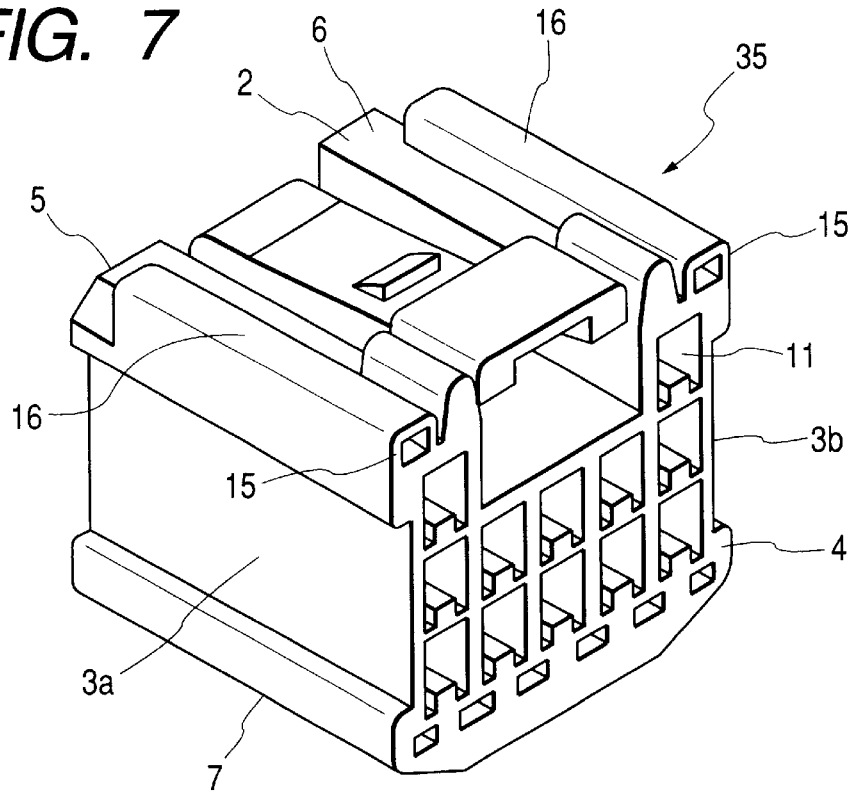
FIG. 7 is a perspective view of a three-dimensional model for performing a flow analysis.
Figure 8:
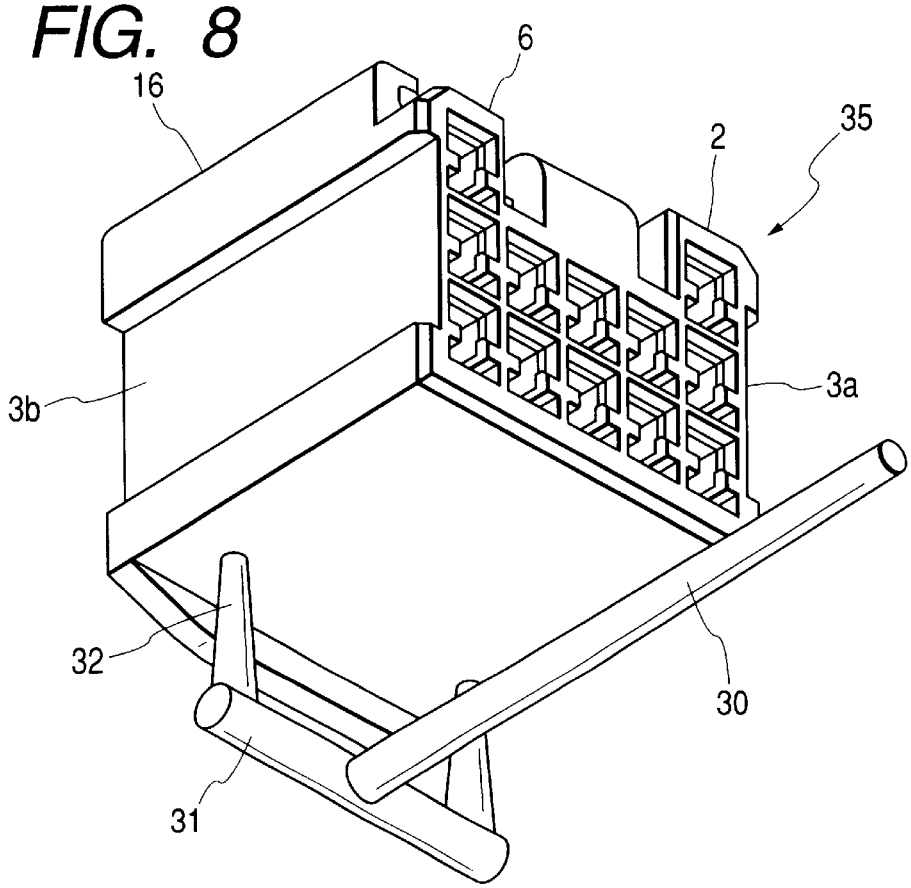
Figure 9:
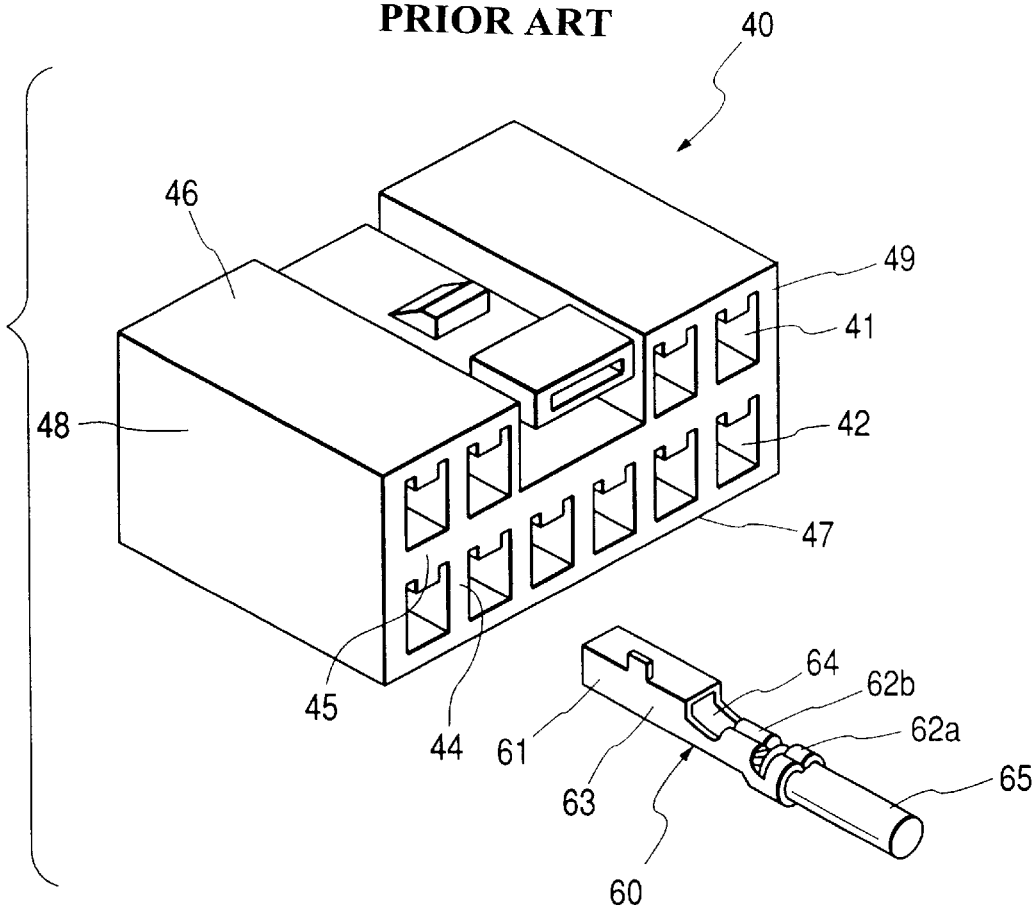
FIG. 9 PRIOR ART
FIG. 9 is a perspective view illustrating an example of a related connector housing.
Figure 10:
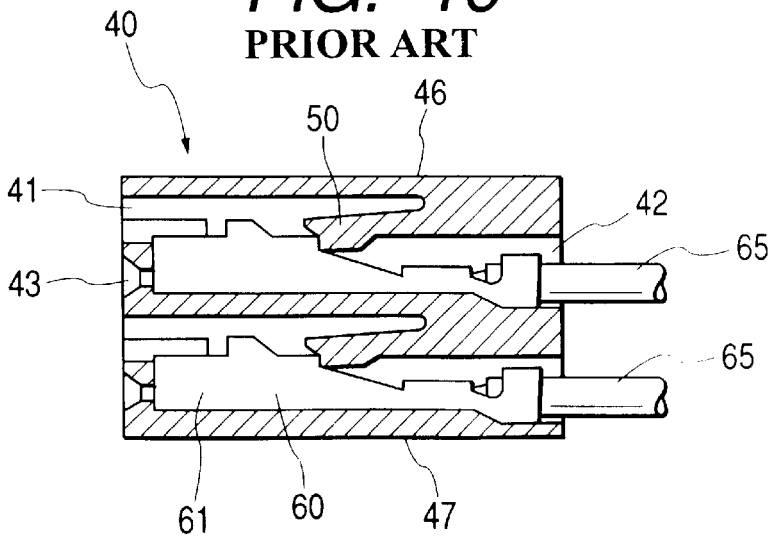
FIG. 10 PRIOR ART
FIG. 10 is a cross-sectional view illustrating a state in which terminals are inserted with a proper attitude in the connector housing shown in FIG. 9.

Here, a detailed description will be given of flow analysis which was conducted on the basis of an analytic model. FIG. 7 shows a three-dimensional model 35 which is divided into square elements to investigate the final filling positions. FIG. 8 shows the positions of the spool 30, the runner 31, and the gates 32 in the three-dimensional model 35. It should be noted that the shape of the divided element may not be the square element, and may be a triangular element or a polygonal element.

In a case where the analysis of flow in cavities is conducted, the finite element method, the boundary element method, the difference calculus, the FAN method, and the like are generally used. In the numerical analysis of the invention, analysis was conducted by using the finite element method, in addition, in the analysis, the molding conditions including the mold temperature, the resin temperature, the filling rate, the filling pressure, and the like were used as input data in addition to material physical property data and shape data. As the material physical property data, the density and specific heat of the mold, the density, specific heat, thermal conductivity of the molten resin, and the like were used. As the shape design data, the wall thickness of the molded product, the gate position, and dimensions of the spool and the runner, and the lime were used.

First, the thin-walled portions 15 for inspecting short-shots in the terminal retaining lances 20 need to be placed at positions where the flow resistance is greater than the terminal retaining lances 20, i.e., at the final filling positions where the molten resin finally flows. The reason is that since, in the invention, the thin walled portions 15 are integrally formed for inspection of the terminal retaining lances 20 to perform the inspection of the short-shots in the terminal retaining lances 20, if the thin-walled portions 15 are not located at the final filling positions, short-shots in the terminal retaining lances cannot be inspected accurately.

As a result of the flow analysis, it became clear that the final filling positions of the thin-walled portions 15 are both sides of the outer wall upper portion 6 of the connector housing 1, so that the thin-walled portions 15 are provided at these positions in the invention.

Next, as shown in FIG. 8, the positions of the spool 30, the runner 31, and the gates 32 are provided at the outer wall lower portion 7 of the connector housing 1 on the opposite side of the thin-walled portions 15. The gates 32 are formed at both ends of the runner 31 which bifurcate to the left and the right from a tip of the spool 30, and are arranged on both sides of the outer wall lower portion 7. The gate positions and the number of gates are extremely important factors in the fluidity of the molten resin and, hence, the moldability of the product, and consideration is given to the fact that the molded product is the connector housing 1 having the plurality of terminal chambers 11. Consequently, the arrangement provided is such that the molten resin can be allowed to flow with a good balance.

Although the flow analysis is conducted strictly through computer processing using an analytic model, and does not necessarily produce almighty results, there are advantages in that the design of the injection moldings including such as the spool 30, the runner 31, and the gates 32 can be effected systematically, and that design can be effected rationally and economically.

As described above, the thin-walled portion for inspecting a short-shot in the terminal retaining lance provided projectingly on an inner wall of each terminal chamber of the connector housing is a portion where a short-shot in which a molten resin is filled last is most likely to occur. Namely, if the external appearance of the thin-walled portion is checked, and a short-shot cannot be detected, it can be estimated that there are no short-shots in the terminal retaining lances, and that the product can be evaluated as being nondefective. To the contrary, if there is a defect in the external appearance of the thin-walled portion, it can be estimated that there is a defect in the terminal retaining lance. Consequently, it is possible to detect defects easily in a short time without performing inspection in a time-consuming manner. In addition, the operating rate improves, and productivity can be increased. Further, the terminals are prevented from coming off the connector housing, and the reliability in electrical connection improves.

Although the present invention has been shown and described with reference to specific preferred embodiments, various changes and modifications will be apparent to those skilled in the art from the teachings herein. Such changes and modifications as are obvious are deemed to come within the spirit scope and contemplation of the invention as defined in the appended claims.

What is claimed is:

1. A connector housing, formed with a chamber into which a terminal is inserted, comprising:

a retention member, formed in the chamber so as to retain the inserted terminal therein, the retention member formed by a first portion of a mold which molds the housing; and an inspection member, formed on an outer face of the housing, to be used only for inspecting molding defect of the retention member, the inspection member formed by a second portion of the mold having a higher flow resistance than the first portion of the mold.

2. The connector housing of claim 1, wherein said inspection member is disposed at an outside corner of the housing.

3. The connector housing of claim 2, wherein said inspection member includes a corner portion of the housing having a longitudinal aperture therein defined by a thin walled portion which forms the outside corner of the housing.

4. The connector housing of claim 3, wherein said longitudinal aperture is a through-aperture.

5. A connector housing, formed with a chamber into which a terminal is inserted, comprising:

a retention member, formed in the chamber so as to retain the inserted terminal therein; and an inspection member, formed on an outer face of the housing, to be used only for inspecting molding defect of the retention member, the inspection member having a thickness dimension thinner than the retention member.

6. The mold as set forth in claim 5, further comprising a third portion, from which molten resin for forming the housing is injected, wherein the second portion is furthest from the third portion such that the molten resin is lastly fills the second portion.

7. The connector housing of claim 5, wherein said inspection member is disposed at an outside corner of the housing.

8. The connector housing of claim 7, wherein said inspection member is disposed at an outside corner of the housing.

9. The connector housing of claim 8, wherein said longitudinal aperture is a through-aperture.

10. A mold, for molding a connector housing which is formed with a chamber into which a terminal is inserted, a retention member formed in the chamber so as to retain the inserted terminal therein, and an inspection member for inspecting molding defect of the retention member, comprising:

a first portion, having a first flow resistance, for forming the retention member; and a second portion, having a second low resistance higher than the first flow resistance, for forming the inspection member on an outer face of the housing.

11. The mold of claim 10, wherein said inspection member is disposed at an outside corner of the housing.

12. The mold of claim 11, wherein said inspection member includes a corner portion of the housing having a longitudinal aperture therein defined by a thin walled portion which forms the outside corner of the housing.

13. The mold of claim 12, wherein said longitudinal aperture is a through-aperture.

14. A method of manufacturing a connector housing which is formed with a chamber into which a terminal is inserted, a retention member formed in the chamber so as to retain the inserted terminal therein, and an inspection member for inspecting molding defect of the retention member, comprising the steps of:

providing a mold for molding the connector housing;

providing a first portion for forming the retention member in the mold so as to have a first flow resistance member;

providing a second portion for forming the inspection member in the mold at a position which is to be an outer face of the housing, so as to have a second flow resistance higher than the first flow resistance;

injecting molten resin into the mold; and inspecting an external appearance of the molded inspection member to determine whether a molding defect is present on the molded retention member.

15. The manufacturing method as set forth in claim 14, wherein the second portion providing step includes the steps of: providing a third portion in the mold, from which the molten resin is injected; and providing the second portion as a portion where the molten resin lastly fills.

16. The manufacturing method as set forth in claim 15, wherein the second portion providing step includes the step of performing a flow analysis of the molten resin within the mold.

17. The method of claim 14, wherein said inspection member is disposed at an outside corner of the housing.

18. The method of claim 17, wherein said inspection member includes a corner portion of the housing having a longitudinal aperture therein defined by a thin walled portion which forms the outside corner of the housing.

19. The method of claim 18, wherein said longitudinal aperture is a through-aperture.

* * * * *